US010344606B2

(12) United States Patent
Farah et al.

(10) Patent No.: US 10,344,606 B2
(45) Date of Patent: Jul. 9, 2019

(54) STATOR VANE ARRANGEMENT FOR A TURBINE ENGINE

(71) Applicant: United Technologies Corporation, Hartford, CT (US)

(72) Inventors: Jorge I. Farah, Hartford, CT (US); Conway Chuong, Manchester, CT (US); Dana P. Stewart, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 744 days.

(21) Appl. No.: 14/779,846

(22) PCT Filed: Apr. 1, 2014

(86) PCT No.: PCT/US2014/032533

§ 371 (c)(1),
(2) Date: Sep. 24, 2015

(87) PCT Pub. No.: WO2014/165518

PCT Pub. Date: Oct. 9, 2014

(65) Prior Publication Data

US 2016/0053622 A1 Feb. 25, 2016

Related U.S. Application Data

(60) Provisional application No. 61/807,152, filed on Apr. 1, 2013.

(51) Int. Cl.

| | |
|---|---|
| ***F01D 9/04*** | (2006.01) |
| ***F01D 25/16*** | (2006.01) |
| ***F01D 25/00*** | (2006.01) |

(52) U.S. Cl.
CPC ..... *F01D 9/042* (2013.01); *F01D 25/005* (2013.01); *F01D 25/162* (2013.01); *F05D 2240/12* (2013.01)

(58) Field of Classification Search
CPC ..... F01D 9/042; F01D 25/005; F01D 25/162; F05D 2240/12
USPC ..... 415/191
See application file for complete search history.

(56) References Cited

U.S. PATENT DOCUMENTS

| | | | | |
|---|---|---|---|---|
| 4,643,636 | A * | 2/1987 | Libertini | F01D 5/284 415/138 |
| 5,332,360 | A * | 7/1994 | Correia | F01D 9/042 29/889.21 |
| 5,630,700 | A | 5/1997 | Olsen et al. | |
| 5,765,993 | A | 6/1998 | Weiss | |
| 5,797,725 | A * | 8/1998 | Rhodes | B23P 6/005 415/209.2 |
| 7,722,318 | B2 * | 5/2010 | Addis | B23P 6/005 415/148 |
| 2007/0183891 | A1 | 8/2007 | Evans et al. | |

(Continued)

*Primary Examiner* — Aaron R Eastman
(74) *Attorney, Agent, or Firm* — O'Shea Getz P.C.

(57) ABSTRACT

A stator vane arrangement for a turbine engine includes a first vane platform, a second vane platform and a plurality of stator vanes extending radially between the first and the second vane platforms. The first and the second vane platforms extend circumferentially around an axis, and the first vane platform includes an aperture. The stator vanes are arranged circumferentially around the axis, and include a first stator vane that extends radially into the aperture and is fastened to the first vane platform.

11 Claims, 9 Drawing Sheets

(56) References Cited

U.S. PATENT DOCUMENTS

| | | | | |
|---|---|---|---|---|
| 2008/0232956 | A1* | 9/2008 | Baldauf | F01D 5/22 415/174.2 |
| 2010/0111682 | A1* | 5/2010 | Scoggins | F01D 9/041 415/191 |
| 2010/0132374 | A1* | 6/2010 | Manteiga | F01D 9/02 60/796 |
| 2010/0135777 | A1* | 6/2010 | Manteiga | F01D 9/02 415/190 |
| 2010/0166540 | A1* | 7/2010 | Perez | F01D 17/162 415/148 |
| 2010/0254804 | A1 | 10/2010 | Harper | |
| 2010/0310358 | A1* | 12/2010 | Major | F01D 17/162 415/159 |
| 2011/0110783 | A1* | 5/2011 | Addis | B23P 6/005 416/219 R |
| 2012/0107124 | A1* | 5/2012 | Farah | F01D 9/042 416/220 R |
| 2012/0151937 | A1* | 6/2012 | Muscat | F01D 5/027 60/805 |
| 2014/0007588 | A1* | 1/2014 | Sanchez | F01D 9/065 60/796 |
| 2014/0212284 | A1* | 7/2014 | Jamison | F01D 9/041 415/208.2 |
| 2015/0354380 | A1* | 12/2015 | Roberts | F01D 5/147 415/148 |

* cited by examiner

STATOR VANE ARRANGEMENT FOR A TURBINE ENGINE

CROSS-REFERENCE TO RELATED APPLICATIONS

This application claims priority to PCT Patent Application No. PCT/US14/32533 filed Apr. 1, 2014, which claims priority to U.S. Patent Appln. No. 61/807,152 filed Apr. 1, 2013.

BACKGROUND OF THE INVENTION

1. Technical Field

This disclosure relates generally to a turbine engine and, more particularly, to a stator vane arrangement that directs a flow of gas in a turbine engine.

2. Background Information

A typical turbine engine includes a fan section, a compressor section, a combustor section and a turbine section. The engine may also include a stator vane arrangement. The stator vane arrangement may guide a flow of core gas into the turbine section. Alternatively, the stator vane arrangement may guide the flow of core gas between adjacent stages of the turbine section.

A typical stator vane arrangement includes a plurality of circumferential vane arrangement segments. Each vane arrangement segment includes one or more stator vane airfoils that extend radially between an inner platform segment and an outer platform segment. The vane airfoils as well as the inner and the outer platform segments are formed integral with one another; e.g., cast as a unitary body singlet or doublet.

Exterior surfaces of the vane airfoils and/or gas path surfaces of the inner and the outer platform segments may be coated with an oxidation or thermal barrier layer. A thermal barrier layer may partially insulate the vane arrangement segment material from relatively hot core gas that flows through the turbine section during engine operation. An oxidation coating may primarily increase oxidation and corrosion resistance of the parent alloy material. One or more of the vane airfoils and/or relatively large overhangs of one or more of the platforms segments may create blind spots during a typical line of sight coating process. These blind spots may increase the time and/or expense of coating the vane arrangement segment. The blind spots may also prevent an even coating from being applied to the vane arrangement segment, which may increase thermal fatigue of the vane arrangement segment material during engine operation.

There is a need in the art for an improved stator vane arrangement.

SUMMARY OF THE DISCLOSURE

According to an aspect of the invention, a stator vane arrangement is provided for a turbine engine. The stator vane arrangement includes a first vane platform, a second vane platform and a plurality of stator vanes that extend radially between the first and the second vane platforms. The first and the second vane platforms extend circumferentially around an axis. The first vane platform includes an aperture. The stator vanes are arranged circumferentially around the axis. The stator vanes include a first stator vane that extends radially into the aperture and is fastened to the first vane platform.

According to another aspect of the invention, an engine assembly is provided for a turbine section of a turbine engine. The engine assembly includes a stator vane arrangement for directing gas into or through the turbine section. The vane arrangement includes a first vane platform, a second vane platform and a plurality of vanes. The vanes are arranged circumferentially around an axis and extend radially between the first and the second vane platforms. The first vane platform includes an aperture. The stator vanes include a first stator vane that extends radially into the aperture and that is mechanically fastened to the first vane platform.

According to still another aspect of the invention, a turbine engine is provided that includes a plurality of engine sections arranged along an axis. The engine sections include a compressor section, a combustor section and a turbine section. The turbine engine also includes a stator vane arrangement that directs gas for one of the engine sections. The stator vane arrangement includes a first vane platform, a second vane platform and a plurality of vanes. The vanes are arranged circumferentially around the axis and extend radially between the first and the second vane platforms. The first vane platform includes an aperture. The stator vanes include a first stator vane that extends radially into the aperture and is fastened to the first vane platform.

The first vane platform and/or the second vane platform may each be configured as or include a unitary annular body.

The first vane platform and/or the second vane platform may each be configured at least partially from sheet metal.

The second vane platform may be configured as or include an outer vane platform. The first vane platform may be configured as or include an inner vane platform, which is arranged radially within the outer vane platform.

The first vane platform may be configured as or include an outer vane platform. The second vane platform may be configured as or include an inner vane platform, which is arranged radially within the outer vane platform.

The second vane platform may include a second aperture. The first stator vane may extend radially into the second aperture. The first stator vane may be fastened to the second platform.

The aperture may be one of a plurality of apertures included in the first vane platform. The stator vanes may respectively extend radially into the apertures, and may be fastened to the first vane platform.

The first stator vane may be configured as or include a hollow airfoil.

A seal element may at least partially or substantially seal a gap between the first vane platform and the first stator vane. The seal element may be configured as or include a seal ring through with the first stator vane extends. The seal element may also or alternatively be configured as or include a boot.

The aperture may extend radially into the first vane platform to a surface. The first stator vane may radially engage the surface.

The aperture may extend radially through the first vane platform. The first stator vane may extend radially through the aperture to a flange, which may radially engage the first vane platform.

A boot may be connected to the first vane platform. The aperture may extend radially through the first vane platform. The first stator vane may extend radially through the aperture and into the boot.

The first stator vane may extend radially through the boot to a flange. The flange may radially engage the boot.

A collar may be connected to the first stator vane and radially engage the first vane platform.

A platform reinforcement element may be connected to the first vane platform. The reinforcement element may be arranged radially between the first vane platform and the first stator vane.

A gear train may connect a rotor in a first of the engine sections to a rotor in a second of the engine sections. The engine sections may include a fan section that is configured as or includes the first of the engine sections.

The foregoing features and the operation of the invention will become more apparent in light of the following description and the accompanying drawings.

DETAILED DESCRIPTION OF THE INVENTION

Figure 1:
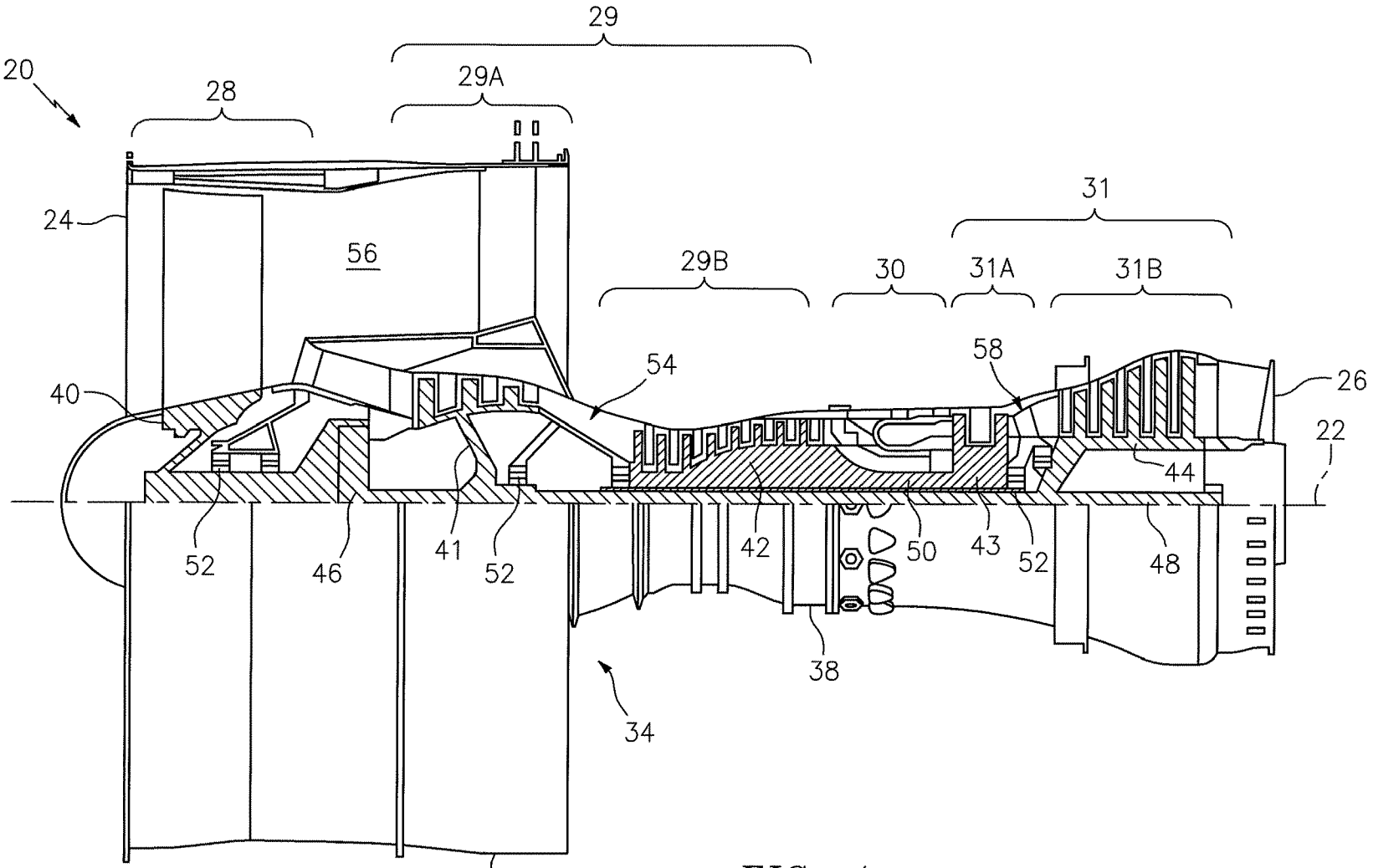
FIG. 1 is a side cutaway illustration of a geared turbine engine.

FIG. 1 is a side cutaway illustration of a geared turbine engine 20. This turbine engine 20 extends along an axis 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected (e.g., formed integral, mechanically fastened, welded, brazed or otherwise adhered) to one or more respective rotor disks. The fan rotor 40 is connected to a gear train 46; e.g., an epicyclic gear train. The gear train 46 and the LPC rotor 41 are connected to and driven by the LPT rotor 44 through a low speed shaft 48. The HPC rotor 42 is connected to and driven by the HPT rotor 43 through a high speed shaft 50. The low and high speed shafts 48 and 50 are rotatably supported by a plurality of bearings 52. Each of the bearings 52 is connected to the second engine case 38 by at least one stator such as, for example, an annular support strut.

Air enters the turbine engine 20 through the airflow inlet 24, and is directed through the fan section 28 and into an annular core gas path 54 and an annular bypass gas path 56. The air within the core gas path 54 may be referred to as "core gas". The air within the bypass gas path 56 may be referred to as "bypass gas" or "cooling gas". The core gas is directed through the engine sections 29-31 and exits the turbine engine 20 through the airflow exhaust 26. Within the combustion section 30, fuel is injected into and mixed with the core gas and ignited to provide forward engine thrust. The bypass gas is directed through the bypass gas path 56 and out of the turbine engine 20 to provide additional forward engine thrust or reverse thrust via a thrust reverser. The bypass gas may also be utilized to cool various turbine engine components within one or more of the engine sections 29-31.

Referring still to FIG. 1, the turbine engine 20 also includes at least one stator vane arrangement 58. The stator vane arrangement 58 of FIG. 1 is configured as a mid turbine stator vane arrangement, and directs (e.g., guides) the flow of core gas through the turbine section 31. The stator vane arrangement 58, for example, guides the flow of core gas between adjacent stages of the HPT section 31A and the LPT section 31B. In alternative embodiments, however, the stator vane arrangement 58 may direct the flow of gas into, through or between any one or more of the engine sections 28, 29, 29A, 29B, 31, 31A and 31B.

Figure 2:
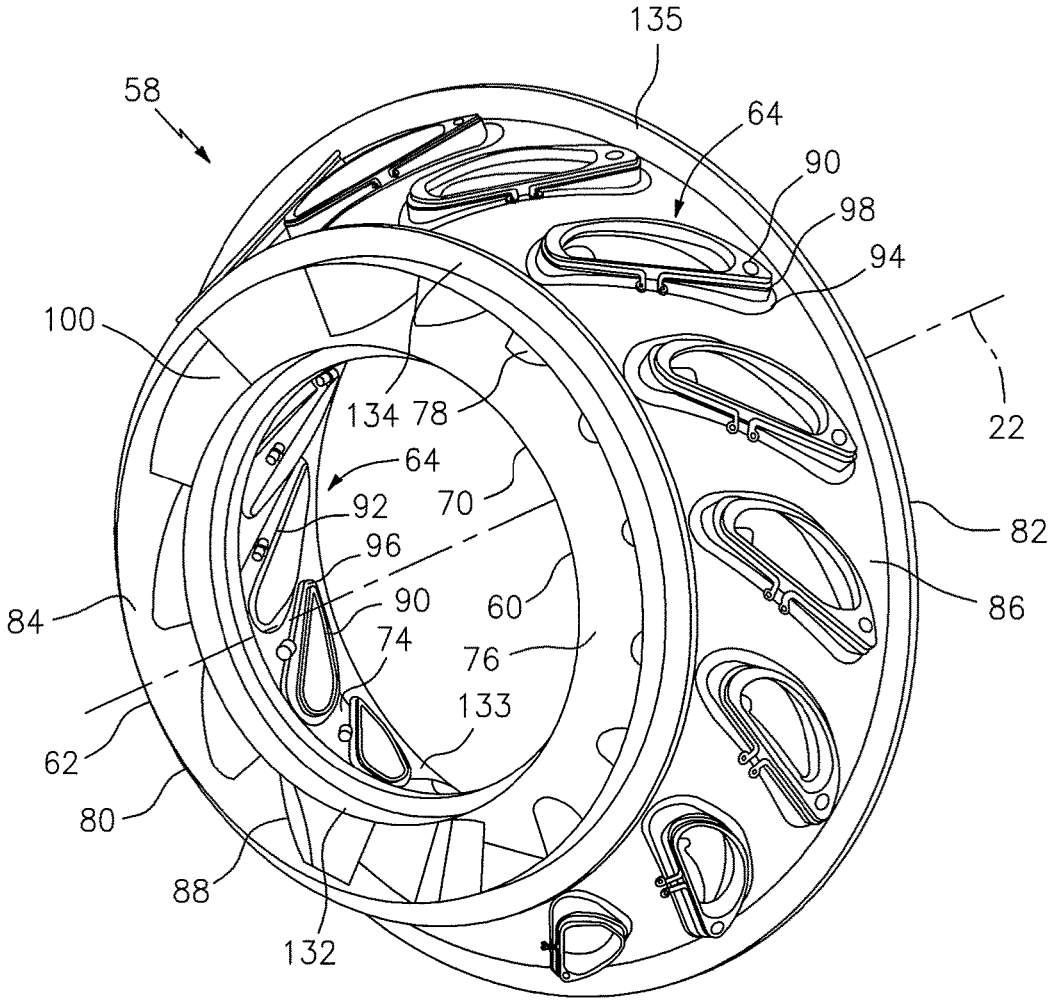
FIG. 2 is a perspective illustration of a stator vane arrangement.

FIG. 2 is a perspective illustration of the stator vane arrangement 58. The stator vane arrangement 58 includes an inner vane platform 60, an outer vane platform 62, and a plurality of stator vane assemblies 64.

Figure 3:
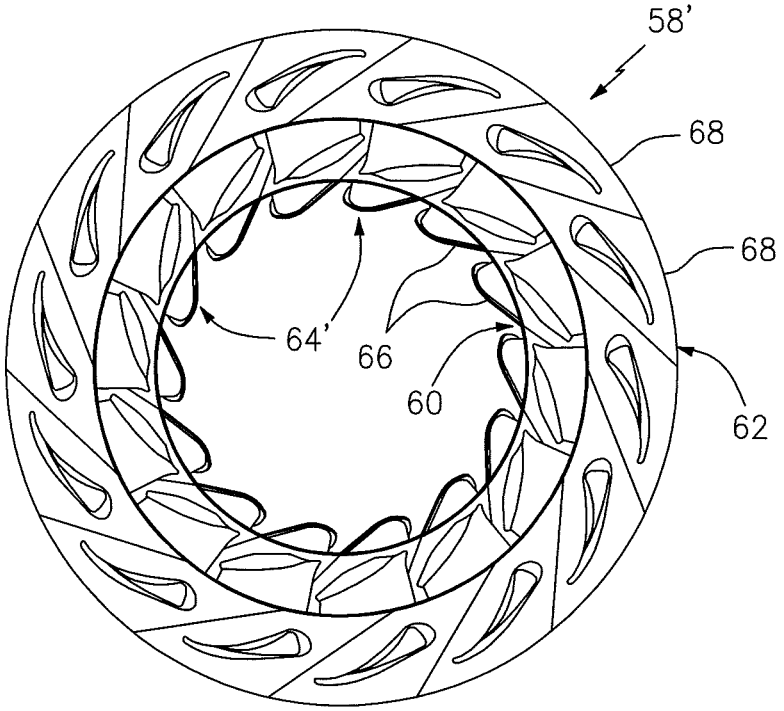
FIG. 3 is an illustration of an end of an alternative embodiment stator vane arrangement.

The inner vane platform 60 and/or the outer vane platform 62 may each be configured as a unitary tubular body; e.g., a vane platform hoop. The inner vane platform 60 and/or the outer vane platform 62, for example, may each be formed (e.g., hydroformed and/or otherwise shaped) from a sheet of metal (e.g., nickel or cobalt alloy sheet metal) or any other suitable material. In another example, the inner vane platform 60 and/or the outer vane platform 62 may each be cast as and/or milled, forged or otherwise constructed from a unitary body; e.g., from a circumferentially non-segmented body or a block of material. Alternatively, one or more of the vane platforms 60 and 62 may each be respectively configured from a plurality of circumferentially extending platform segments 66 and 68 as illustrated in FIG. 3. One or more of these platform segments 66 and 68 may each be configured as a unitary body. Alternatively, one or more of the platform segments 66 or 68 may be formed integrally with at least a portion of a respective stator vane assembly 64'.

Figure 4:
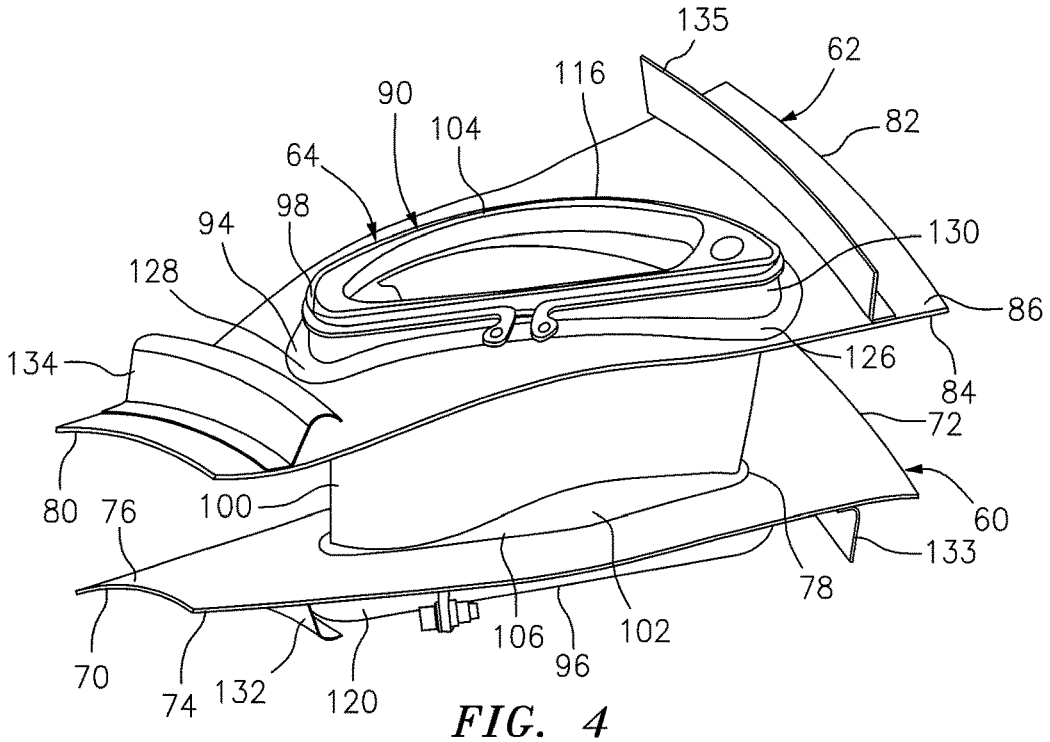
FIG. 4 is a perspective illustration of a circumferential portion of the stator vane arrangement of FIG. 2.
Figure 5:
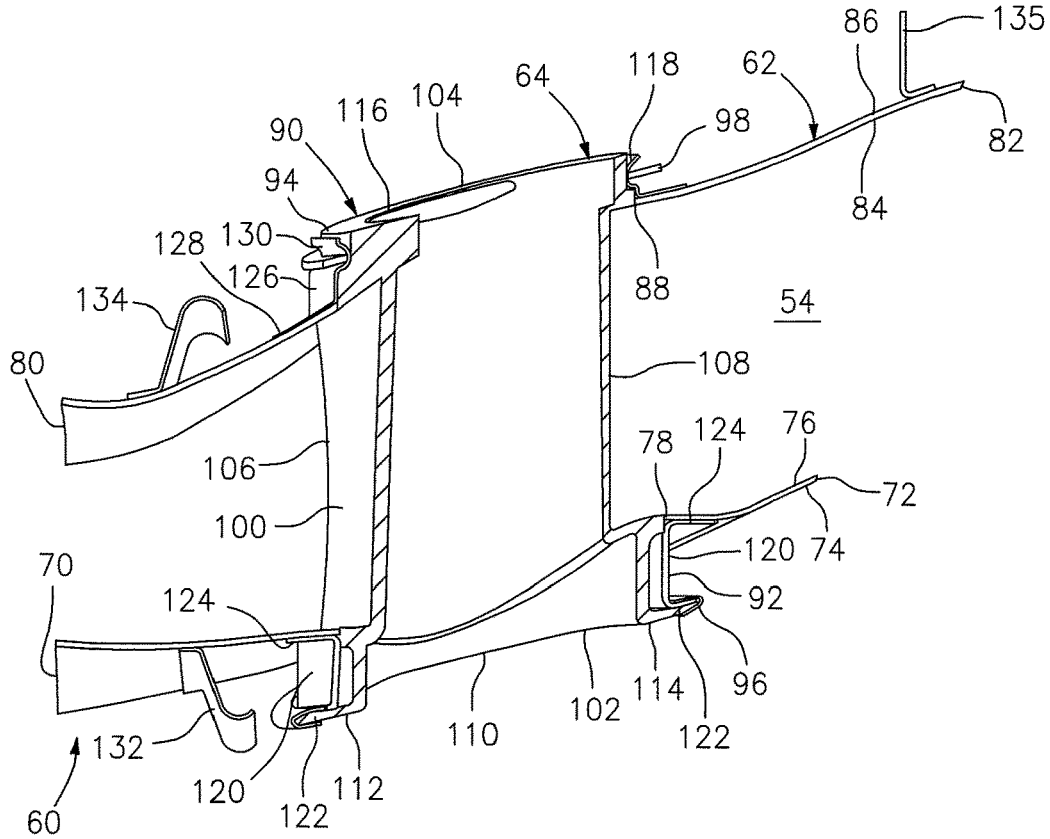
FIG. 5 is a cross-sectional illustration of the circumferential portion of the stator vane arrangement of FIG. 4.

Referring to FIGS. 2, 4 and 5, the inner vane platform 60 extends circumferentially around the axis 22. The inner vane platform 60 extends axially between an upstream end 70 and a downstream end 72. The inner vane platform 60 extends radially between an inner platform side 74 and an outer platform side 76. The outer platform side 76 partially defines an inner surface of the core gas path 54 (see FIG. 1), and may be coated with a thermal barrier layer (e.g., a high temperature ceramic coating) and/or any other type of coating. The thermal barrier layer may be substantially uniformly applied onto the outer platform side 76 via a line of sight process, for example before stator vane arrangement assembly, since the inner vane platform 60 embodiment of FIG. 2 is discrete from the stator vane assemblies 64 and the outer vane platform 62. The inner vane platform 60 includes one or more vane apertures 78, which are arranged circumferentially around the axis 22. One or more of the vane apertures 78 each extend radially through the inner vane platform 60 between the inner platform side 74 and the outer platform side 76.

The outer vane platform 62 extends circumferentially around the axis 22. The outer vane platform 62 extends axially between an upstream end 80 and a downstream end 82. The outer vane platform 62 extends radially between an inner platform side 84 and an outer platform. side 86. The inner platform side 84 partially defines an outer surface of the core gas path 54 (see FIG. 1), and may be coated with a thermal barrier layer (e.g., a high temperature ceramic coating) and/or any other type of coating. The thermal barrier layer may be substantially uniformly applied onto the inner platform side 84 via a line of sight process, for example before stator vane arrangement assembly, since the outer vane platform 62 embodiment of FIG. 2 is discrete from the stator vane assemblies 64 and the inner vane platform 60. The outer vane platform 62 includes one or more vane apertures 88, which are arranged circumferentially around the axis 22. One or more of the vane apertures 88 each extend radially through the outer vane platform 62 between the inner platform side 84 and the outer platform side 86.

The stator vane assemblies 64 are arranged circumferentially around the axis 22. One or more of the stator vane assemblies 64 each includes a stator vane 90 (e.g., a hollow stator vane), an inner vane boot 92 (e.g., an annular vane boot), an outer vane boot 94 (e.g., an annular vane boot), a first fastener 96 (e.g., an annular seal ring clamp), and a second fastener 98 (e.g., a parti- or semi-annular clip).

Referring to FIGS. 4 and 5, the stator vane 90 includes an airfoil 100, an inner vane mount 102 and an outer vane mount 104. The stator vane 90 may be configured as a unitary body. The vane portions 100, 102 and 104, for example, may be cast or otherwise formed integrally with one another. Alternatively, the inner vane mount 102 and/or the outer vane mount 104 may be fastened (e.g., mechanically or bonded) to the airfoil 100.

Referring still to FIGS. 4 and 5, the airfoil 100 includes a generally concave side surface 106 and a generally convex side surface 108. These side surfaces 106 and 108 extend axially between an upstream leading edge and a downstream trailing edge. The side surfaces 106 and 108 extend radially between the inner vane mount 102 and the outer vane mount 104, and through the core gas path 54. The side surfaces 106 and 108 may be coated with a thermal barrier layer (e.g., a high temperature ceramic coating) and/or any other type of coating. The thermal barrier layer or oxidation coating may be substantially uniformly applied onto the side surfaces 106 and 108 via a line of sight process, for example before stator vane arrangement assembly, since each stator vane 90 shown in FIG. 2 is discrete from the other stator vanes 90 and the inner and the outer vane platforms 60 and 62.

The inner vane mount 102 includes an annular mount base 110 and an annular mount flange 112. The base 110 extends radially from the airfoil 100 to a stator vane inner end 114. The flange 112 is arranged at (e.g., adjacent, proximate or on) the inner end 114. The flange 112 extends out from and around the base 110.

The outer vane mount 104 extends radially from the airfoil 100 to a stator vane outer end 116. The outer vane mount 104 includes an annular channel 118. The channel 118 extends into and around the outer vane mount 104.

The inner vane boot 92 includes an annular boot base 120 and one or more annular boot flanges 122 and 124. The base 120 extends radially between the inner flange 122 and the outer flange 124. Each of the flanges 120 and 124 extends out from and around the base 120.

The outer vane boot 94 includes an annular boot base 126 and an annular boot flange 128. The base 126 extends radially out from the flange 128, and includes an interior annular rib 130. The flange 128 extends around the base 126.

Referring still to FIGS. 4 and 5, the inner and the outer vane boots 92 and 94 are respectively fastened to the inner and the outer vane platforms 60 and 62 during assembly of the stator vane arrangement 58 of FIG. 2. The flanges 124 and 128, for example, may be respectively mechanically fastened and/or bonded (e.g., welded, brazed or otherwise adhered) to the inner and the outer platform sides 74 and 86. Each inner vane boot 92 is coaxially aligned with a respective one of the vane apertures 78. Each outer vane boot 94 is coaxially aligned with a respective one of the vane apertures 88. The inner vane platform 60 is arranged radially within the outer vane platform 62.

The outer end 116 of each stator vane 90 is guided radially through a respective vane aperture 78 to mate the respective outer vane mount 104 with the outer vane platform 62. Each outer vane mount 104 extends radially through a respective vane aperture 88 and into the respective outer vane boot 94. The rib 130 is arranged within the channel 118, and clamped against the outer vane mount 104 with the second fastener 98. In this manner, the outer vane boot 94 and the second fastener 98 fasten the stator vane 90 to the outer vane platform 62, and may at least partially or substantially seal a gap between the stator vane 90 and the outer vane platform 62. In addition, the outer vane boot 94 positions the respective stator vane 90 circumferentially and/or axially relative to the outer vane platforms 62.

The respective inner vane mount 102 is mated with the inner vane platform 60. Each inner vane mount 102 extends radially through the respective vane aperture 78 and into the respective inner vane boot 92. The mount flange 112 radially engages (e.g., contacts) the inner boot flange 122. The mount flange 112 and the inner boot flange 122 are clamped together with the first fastener 96. In this manner, the inner vane boot 92 fastens the stator vane 90 to the inner vane platform 60, and may at least partially or substantially seal a gap between the stator vane 90 and the inner vane platform 60. In addition, the inner vane boot 92 positions the respective stator vane 90 circumferentially and/or axially relative to the inner vane platforms 60.

In some embodiments, as illustrated in FIG. 2, the stator vane arrangement 58 may include one or more annular bands 132-135; e.g., seal rings. One or more of the bands 132-135 may each be configured as a unitary annular body (e.g., sheet metal hoop). One or more of the bands 132-135 may each be fastened (e.g., mechanically or bonded) to a respective one of the inner and outer vane platforms 60 and 62. Alternatively, one or more of the bands may each be formed integral with the respect vane platform. The bands 132 and 134 are respectively arranged at the upstream ends 70 and 80. The bands 133 and 135 are respectively arranged at the downstream ends 72 and 82. These bands 132-135 may be adapted to seal respective gaps between the vane platforms 60 and 62 and radially adjacent turbine engine structures (not shown) such as inner and outer portions of the second engine case 38.

Figure 8:
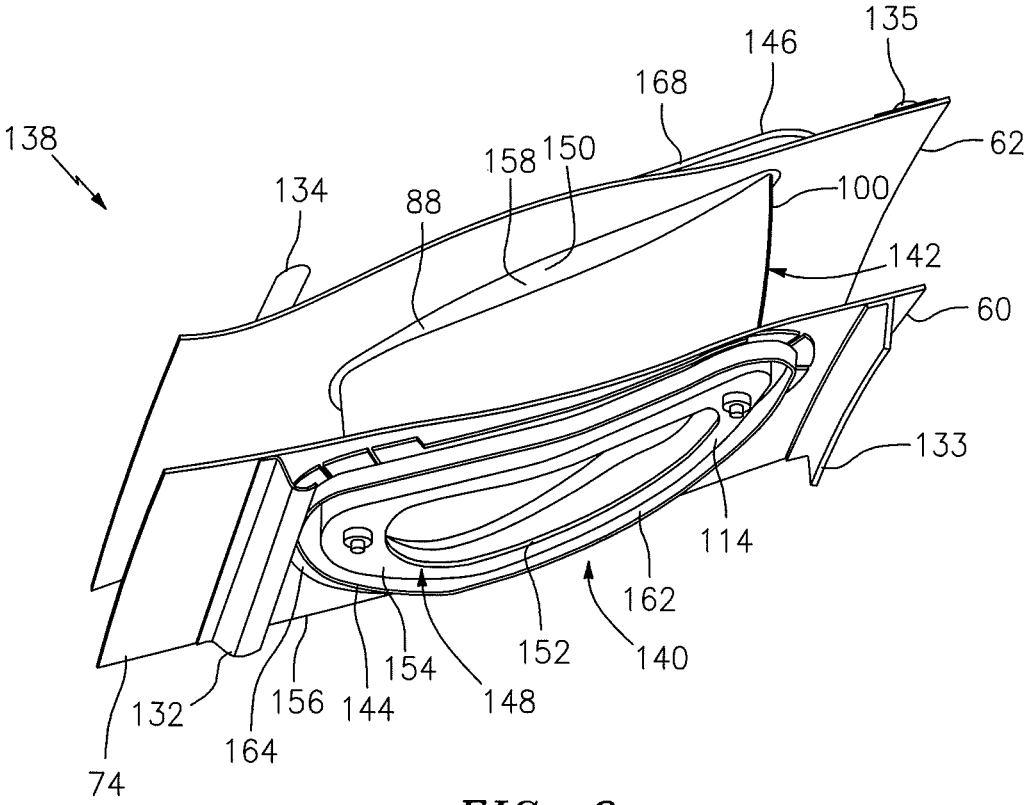
FIG. 8 is another perspective illustration of the circumferential portion of the stator vane arrangement of FIG. 6.
Figure 6:
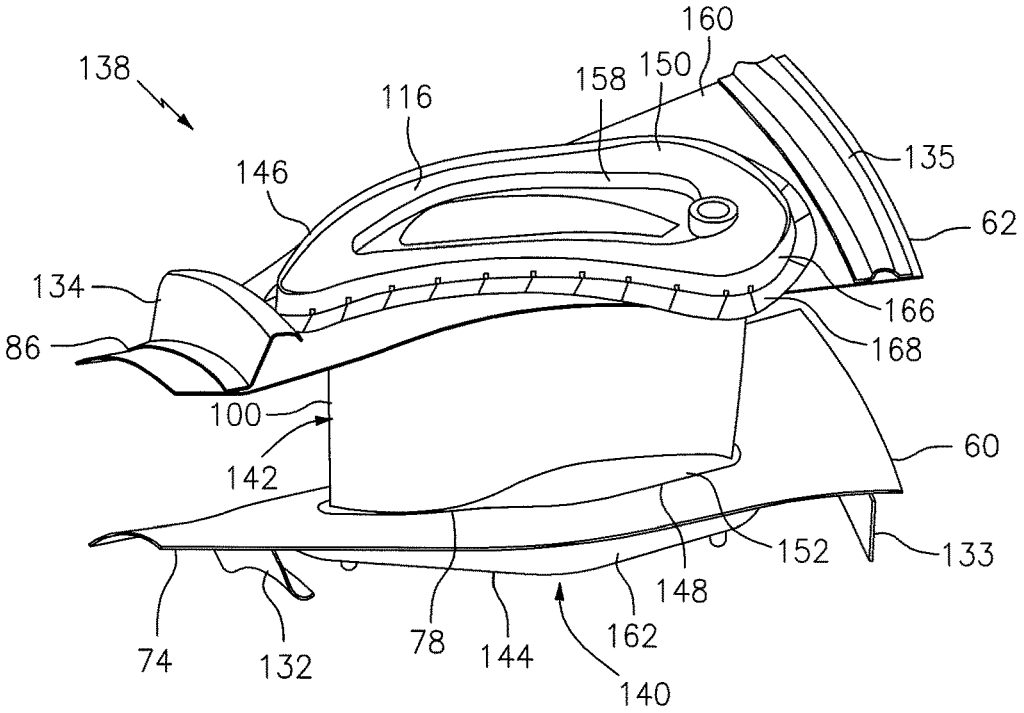
FIG. 6 is a perspective illustration of a circumferential portion of another stator vane arrangement.
Figure 7:
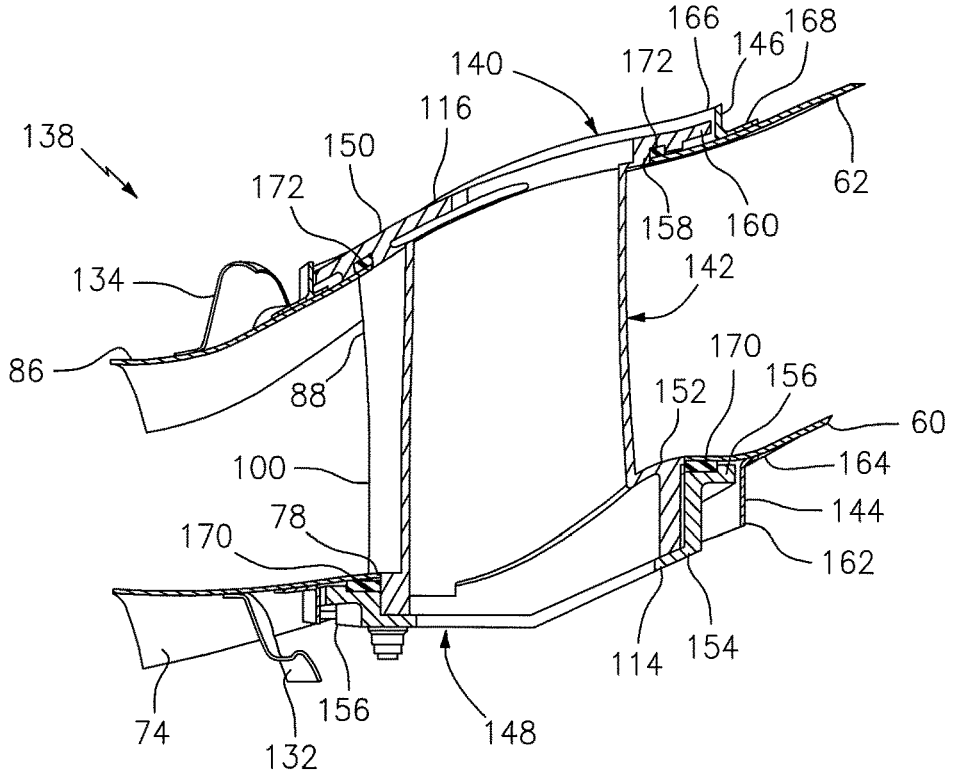
FIG. 7 is a cross-sectional illustration of the circumferential portion of the stator vane arrangement of FIG. 6.

FIGS. 6 to 8 illustrate another stator vane arrangement 138 for the turbine engine 20 of FIG. 1. In contrast to the stator vane arrangement 58 of FIGS. 4 and 5, the stator vane arrangement 138 includes one or more alternate embodiment stator vane assemblies 140. One or more of the stator vane assemblies 140 each includes a stator vane 142 (e.g., a hollow stator vane), an inner vane boot 144 (e.g., an annular vane boot), and an outer vane boot 146 (e.g., an annular vane boot).

The stator vane 142 includes the airfoil 100 arranged and connected radially between an inner vane mount 148 and an outer vane mount 150. The inner vane mount 148 includes an annular mount base 152 and an annular retainer collar 154. The base 152 may be formed integrally with the airfoil 100. The base 152 extends radially from the airfoil 100 towards the stator vane inner end 114. The collar 154 includes an annular collar flange 156 that extends away from and circumscribes the base 152. The outer vane mount 150 includes an annular mount base 158 and an annular mount flange 160. The base 158 extends radially from the airfoil 100 to the stator vane outer end 116. The flange 160 is arranged at (e.g., adjacent, proximate or on) the stator vane outer end 116. The flange 160 extends out from and circumscribes the base 158, and is formed integral with the base 158.

The inner vane boot 144 includes an annular boot base 162 and an annular boot flange 164. The base 162 extends radially in from the flange 164. The flange 164 extends around the base 162, and may be segmented.

The outer vane boot 146 includes an annular boot base 166 and an annular boot flange 168. The base 166 extends radially out from the flange 168. The flange 168 extends around the base 166, and may be segmented.

Referring still to FIGS. 6 to 8, the inner and the outer vane boots 144 and 146 are respectively fastened to the inner and the outer vane platforms 60 and 62 during stator vane arrangement assembly. The flanges 164 and 168, for example, may be respectively mechanically fastened and/or bonded to the inner and the outer platform sides 74 and 86. Each inner vane boot 144 is coaxially aligned with a respective one of the vane apertures 78. Each outer vane boot 146 is coaxially aligned with a respective one of the vane apertures 88.

In contrast to the assembly of the stator vane arrangement 58, the inner end 114 of each stator vane 142 is guided radially through a respective vane aperture 88 to mate the respective inner vane mount 148 with the inner vane platform 60. The mount base 152 extends radially through a respective vane aperture 78 and into the respective inner vane boot 144. The collar 154 is arranged at least partially within the inner vane boot 144. The collar 154 is fastened to the mount base 152 at the stator vane inner end 114 with one or more fasteners; e.g., threaded studs and nuts. The collar flange 156 radially engages the inner platform side 74 through a seal element 170. This seal element 170 may be a seal ring such as, for example, w-seal, an s-seal, a piston seal or any other types of non-segmented or segmented seal ring. The seal element 170 may at least partially or substantially seal a gap between the stator vane 142 and the inner vane platform 60.

The respective outer vane mount 150 is mated with the outer vane platform 62. Each mount base 158 extends radially through the respective vane aperture 88 and into the respective outer vane boot 146. The mount flange 160 radially engages the outer platform side 86 through a seal element 172. This seal element 172 may be a seal ring such as, for example, w-seal, an s-seal, a piston seal or any other types of non-segmented or segmented seal ring. The seal element 172 may at least partially or substantially seal a gap between the stator vane 142 and the outer vane platform 62. In this manner, the mount flange 160 and the collar flange 156 fasten the respective stator vane 142 to the inner and the outer vane platforms 60 and 62.

Figure 9:
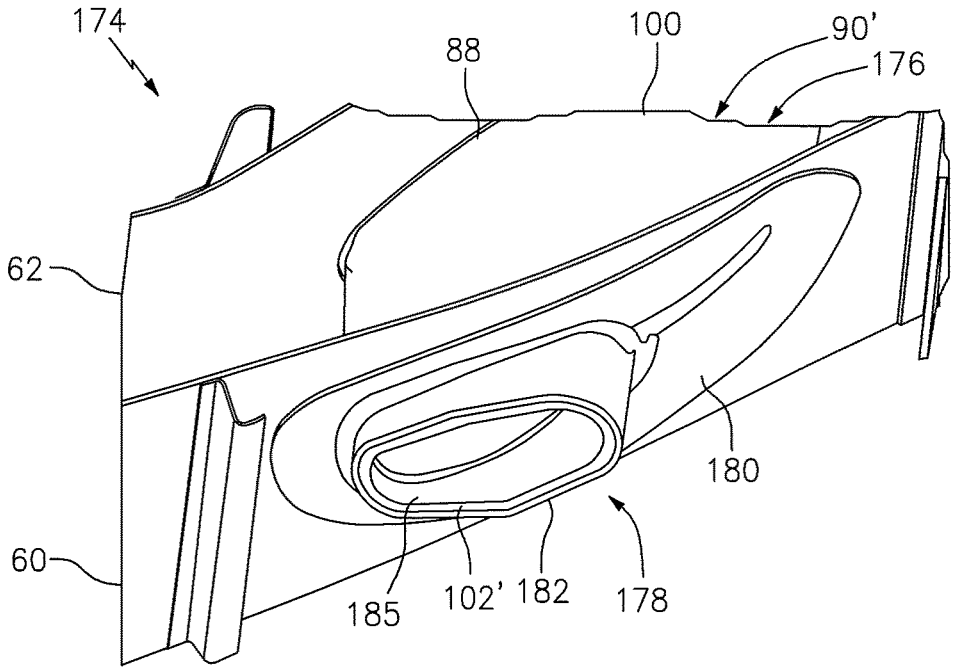
FIG. 9 is a partial perspective illustration of a circumferential portion of another stator vane arrangement.
Figure 10:
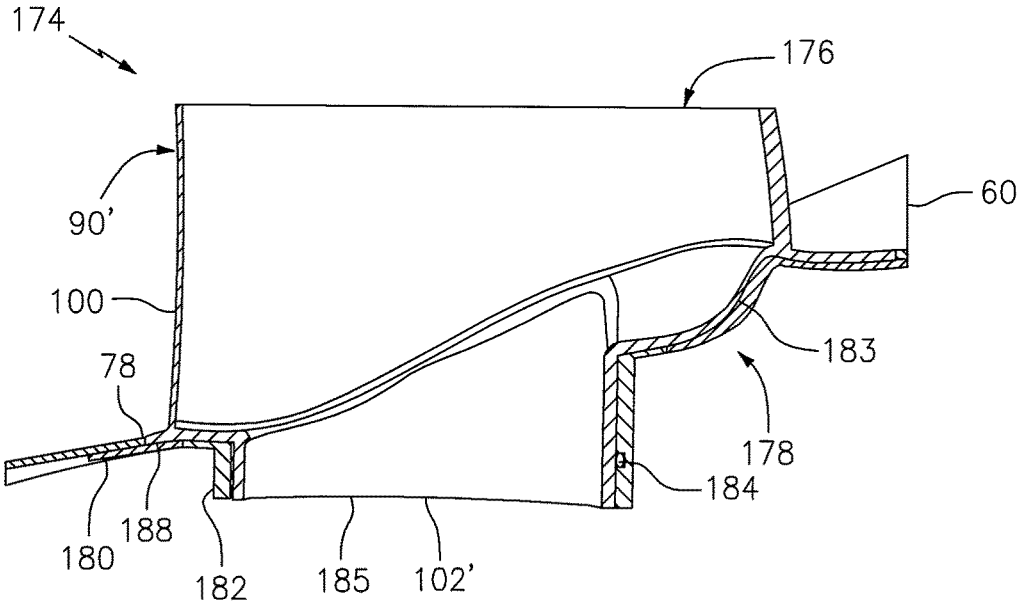
FIG. 10 is a partial cross-sectional illustration of the circumferential portion of the stator vane arrangement of FIG. 9.

FIGS. 9 and 10 illustrate another stator vane arrangement 174 for the turbine engine 20 of FIG. 1. In contrast to the stator vane arrangement 58 of FIGS. 4 and 5, one or more stator vane assemblies 176 of the stator vane arrangement 174 each include an alternate embodiment inner vane boot 178. The inner vane boot 178 includes an annular plate 180 and a sleeve 182. The plate 180 is fastened to the inner vane platform 60 and engages (e.g., contacts) a portion 183 (e.g., an annular plate) of the mount base 102'. The sleeve 182 is fastened to the plate 180, and mated and engaged with a tubular portion 185 of the mount base 102'. A seal element 184 may be arranged between the mount base 102' and the sleeve 182. In this manner, the inner vane boot 178 fastens the stator vane 90' to the inner vane platform 60. Additionally, the inner vane boot 178 and the seal element 184 may at least partially or substantially seal a gap between the stator vane 90' and the inner vane platform 60.

Figure 11:
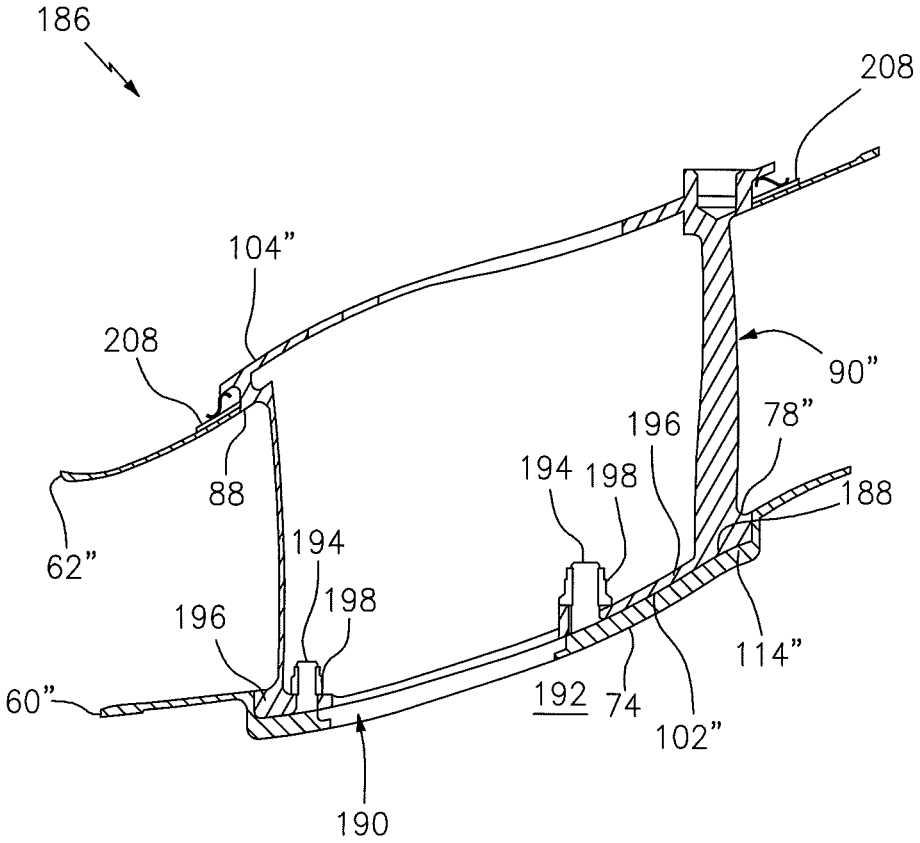
FIG. 11 is a partial side sectional illustration of another stator vane arrangement.
Figure 12:
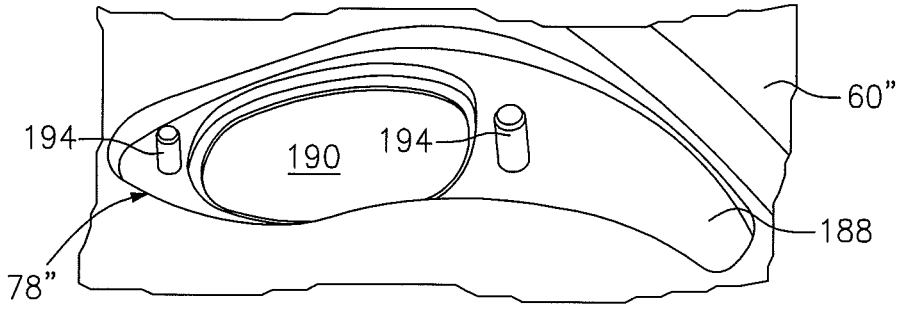
FIG. 12 is a partial illustration of an inner vane platform for the stator vane arrangement of FIG. 11.
Figure 13:
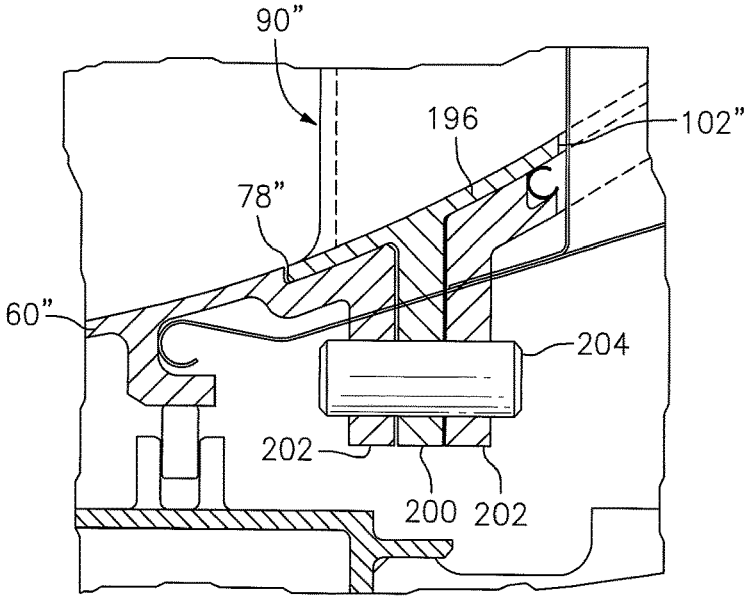
FIG. 13 is a partial side sectional illustration of another stator vane arrangement.
Figure 14:
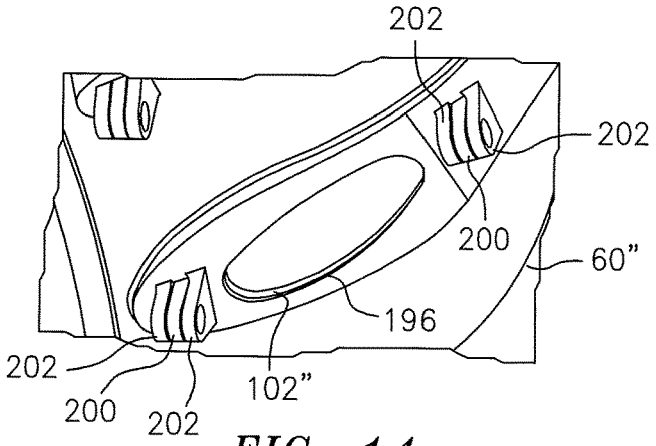
FIG. 14 is a partial perspective illustration of the stator vane arrangement of FIG. 13.
Figure 15:
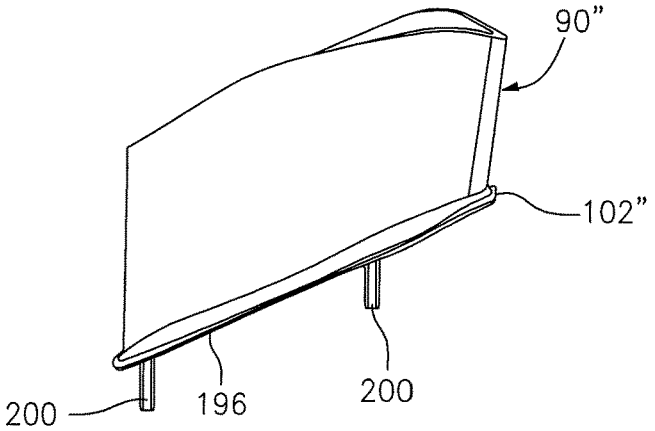
FIG. 15 is a partial illustration of a side of a stator vane for the stator vane arrangement of FIG. 13.

FIGS. 11 and 12 illustrate another stator vane arrangement 186 for the turbine engine 20 of FIG. 1. In contrast to the stator vane arrangement 58 of FIGS. 4 and 5, one or more of the vane apertures 78" each extends partially radially into the inner vane platform 60" to a platform surface 188; e.g., an annular shelf. The inner vane platform 60" may also include one or more vents 190, each of which fluidly couples a respective vane aperture 78" to a plenum 192 adjacent the inner platform side 74. The inner vane mount 102" extends radially into the respective vane aperture 78". The stator vane inner end 114" is arranged adjacent and may radially engage the platform surface 188. The inner vane mount 102" may be fastened to the inner vane platform 60" with one or more fasteners. A plurality of threaded studs 194, for example, may extend radially out from the platform surface 188, through an interior flange 196 of the inner vane mount 102", and mate with respective nuts 198 (see FIG. 11). Alternatively, as illustrated in FIGS. 13 to 15, the inner vane mount 102" may include one or more protrusions 200 (e.g., tabs). Each of the protrusions 200 extends radially through the inner vane platform 60", and is fastened between a respective pair of flanges 202 with a respective fastener 204 such as a pin.

Figure 16:
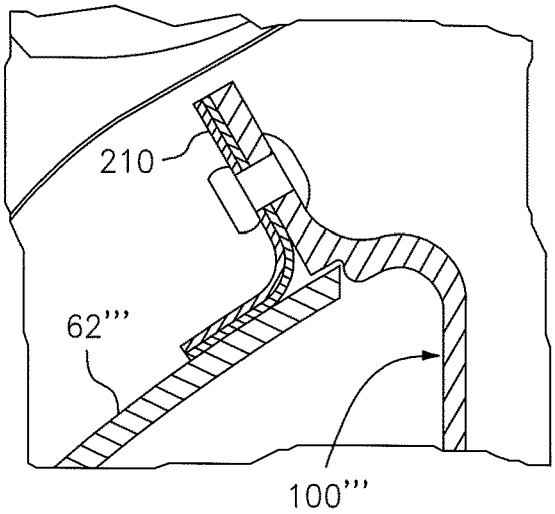
FIG. 16 is a partial side sectional illustration of a vane boot that connects and at least partially seals a gap between a vane platform and a stator vane.
Figure 17:
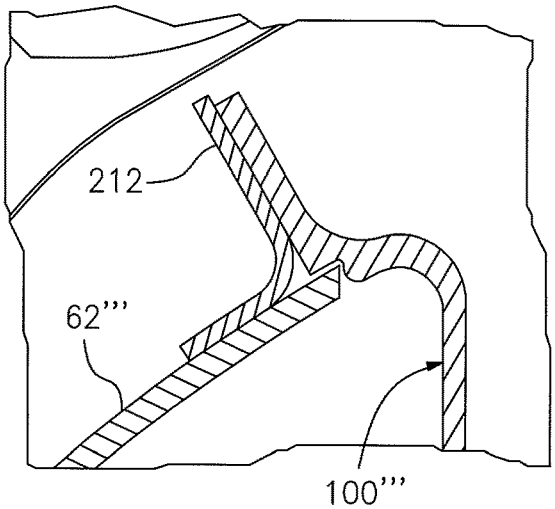
FIG. 17 is a partial side sectional illustration of another vane boot that connects and at least partially seals a gap between a vane platform and a stator vane.
Figure 18:
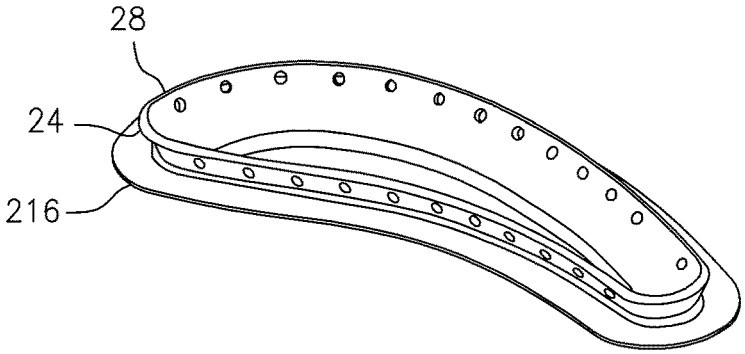
FIG. 18 is a perspective illustration of another vane boot engaged with a stator vane mount.

The afore-described stator vane arrangements and their components may have various configurations other than those described above and illustrated in the drawings. For example, the stator vane arrangement of FIG. 11 may include an annular platform reinforcement element 208, which is connected to the outer vane platform 62" and arranged radially between the outer vane platform 62" and the outer vane mount 104". The inner and the outer vane mounts may have similar configurations. One or more of the vane boots (e.g., vane boot 210) may have a dual (or more) wall construction as illustrated in FIG. 16. Alternatively, one or more of the vane boots (e.g., vane boot 212) may have a single wall construction as illustrated in FIG. 17. The base (e.g., base 214) of one or more of the vane boots (e.g., vane boot 216) may each be flared outwards as illustrated in FIG. 18, and riveted to the respective vane mount (e.g., vane mount 218). The present invention therefore is not limited to any particular stator vane arrangement components or configurations.

The terms "upstream", "downstream", "inner" and "outer" are used to orientate the components of the stator vane arrangements described above relative to the turbine engine and its axis. A person of skill in the art will recognize, however, one or more of these components may be utilized in other orientations than those described above. The present invention therefore is not limited to any particular stator vane arrangement spatial orientations.

A person of skill in the art will recognize the stator vane arrangement may be included in various turbine engines other than the one described above. The stator vane arrangement, for example, may be included in a geared turbine engine where a gear train connects one or more shafts to one or more rotors in a fan section and/or a compressor section. Alternatively, the stator vane arrangement may be included in a turbine engine configured without a gear train. The stator vane arrangement may be included in a turbine engine configured with a single spool, with two spools as illustrated in FIG. 1, or with more than two spools. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A stator vane arrangement for a turbine engine, comprising:

a first vane platform and a second vane platform, the first and the second vane platforms extending circumferentially around an axis, and the first vane platform including an aperture; and a plurality of stator vanes arranged circumferentially around the axis and extending radially between the first and the second vane platforms, the stator vanes including a first stator vane that extends radially into the aperture and is fastened to the first vane platform;

wherein the aperture extends radially through the first vane platform; and wherein the first stator vane extends radially through the aperture to a flange that radially contacts the first vane platform.

2. The vane arrangement of claim 1, further comprising:

a boot connected to the first vane platform;

wherein the first stator vane extends radially through the aperture and into the boot.

3. The vane arrangement of claim 1, wherein the first vane platform comprises a unitary annular body.

4. The vane arrangement of claim 1, wherein the first vane platform comprises an outer vane platform; and the second vane platform comprises an inner vane platform that is arranged radially within the outer vane platform.

5. The vane arrangement of claim 1, wherein the second vane platform includes a second aperture;

the first stator vane extends radially into the second aperture; and the first stator vane is fastened to the second platform.

6. The vane arrangement of claim 1, wherein the aperture is one of a plurality of apertures included in the first vane platform; and the stator vanes respectively extend radially into the apertures, and are fastened to the first vane platform.

7. The vane arrangement of claim 1, wherein the first stator vane comprises a hollow airfoil.

8. The vane arrangement of claim 1, further comprising a seal element that at least partially seals a gap between the first vane platform and the first stator vane.

9. The vane arrangement of claim 8, wherein the seal element comprises a seal ring through which the first stator vane extends.

10. A stator vane arrangement for a turbine engine, comprising:

a first vane platform and a second vane platform, the first and the second vane platforms extending circumferentially around an axis, and the first vane platform including an aperture;

a plurality of stator vanes arranged circumferentially around the axis and extending radially between the first and the second vane platforms, the stator vanes including a first stator vane that extends radially into the aperture and is fastened to the first vane platform; and a boot bonded to the first vane platform;

wherein the aperture extends radially through the first vane platform;

wherein the first stator vane extends radially through the aperture and into the boot; and wherein the first stator vane extends radially through the boot to a flange that radially engages the boot.

11. The vane arrangement of claim 10, wherein the second vane platform comprises an outer vane platform; and the first vane platform comprises an inner vane platform that is arranged radially within the outer vane platform.

* * * * *